United States Patent [19]

Walters

[11] Patent Number: 4,667,571

[45] Date of Patent: May 26, 1987

[54] HYDRAULIC CONTROL SYSTEM

[75] Inventor: Ronald B. Walters, Wembley, England

[73] Assignee: Vickers, Incorporated, Troy, Mich.

[21] Appl. No.: 408,752

[22] Filed: Aug. 17, 1982

[30] Foreign Application Priority Data

Aug. 21, 1981 [GB] United Kingdom ..... 8125585

[51] Int. Cl.[4] ..... F15B 11/10

[52] U.S. Cl. ..... 91/445; 91/461

[58] Field of Search ..... 91/433, 461, 170 MP, 91/445, 448; 137/596.13, 625.64

[56] References Cited

U.S. PATENT DOCUMENTS

| | | | |
|---|---|---|---|
| 3,878,765 | 4/1975 | Walters et al. | 91/433 |
| 4,011,888 | 3/1977 | Whelchel et al. | 137/596.13 |
| 4,111,283 | 9/1978 | Hastings, Jr. | 91/433 |
| 4,392,415 | 7/1983 | Melocik | 91/461 |
| 4,411,189 | 10/1983 | Miller | 137/596.13 |
| 4,418,612 | 12/1983 | Nanda | 91/445 |

FOREIGN PATENT DOCUMENTS

| | | | |
|---|---|---|---|
| 2050646 | 1/1981 | United Kingdom | 91/445 |

*Primary Examiner*—Carlton R. Croyle
*Assistant Examiner*—T. Olds
*Attorney, Agent, or Firm*—Barnes, Kisselle, Raisch, Choate, Whittemore & Hulbert

[57] ABSTRACT

A hydraulic system includes a pilot controlled, pressure operated, spool valve (2) which acts substantially as a by-pass valve when regulating supply of fluid to an actuator (8), and as an in-line valve when regulating the return flow of fluid from the actuator (8) to tank. Both these regulating functions are provided by means of a single main valve spool (31). A flow sensor (20) provides negative feedback to the pilot valve in both by-pass and in-line modes of operation of the main valve, which makes the operation of the system substantially independent of load, temperature, and pump flow. If it is essential that the actuator (8), once it has reached a desired level, remains at that level, the system may additionally incorporate a releasable non-return valve (7) in the service line (71) from the main valve (2) to the actuator (8). This non-return valve is inserted into the service line such that it opens under the pressure of fluid flowing from the main valve (2) to the actuator (8), closes under the back pressure of the load, and is opened by a suitable mechanism when fluid is returned from the actuator to tank under the back pressure of the load. The control system is primarily intended for use with hydraulically operated lifts, but may also be used in other hydraulic systems in which the actuator is to be moved in one direction under pressure supplied to it, and returns to its original position under the action of a return force, e.g. gravity.

3 Claims, 2 Drawing Figures

HYDRAULIC CONTROL SYSTEM

Figure 1:
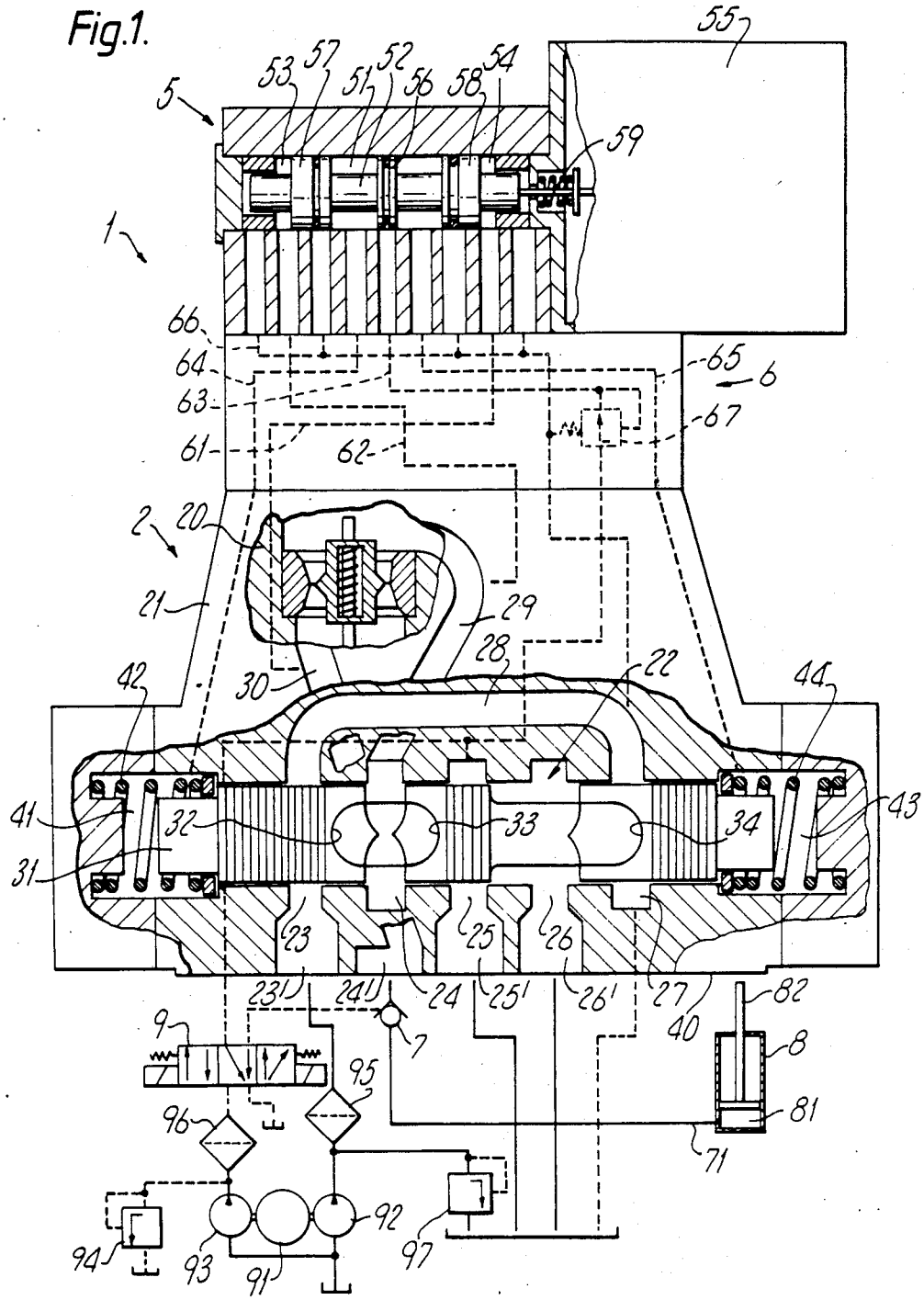

The present invention relates to hydraulic control systems.

In some hydraulic systems the operation of a hydraulic actuator, or actuators, is subject to two opposing forces, the first of which is provided by hydraulic fluid under pressure, the other being the result of a restoring force. For example, gravity in the form of the weight of the load, or return springs, may oppose the force due to the hydraulic pressure applied to move the load in one direction and, on ceasing of the pressure, act to return the load to its original position by moving it in the reverse direction. The rate of movement of the actuator in the first direction can be controlled by regulating the rate of fluid flow to the actuator, and in the reverse direction by regulating the rate of fluid flow returning from the actuator to tank. Such systems may, for example, be applied to operate hydraulic lifts.

It is an aim of the present invention to provide a hydraulic control system of the afore-mentioned kind, in which both directions of movement can be controlled by a single valve.

A further aim of the present invention is to provide a hydraulic control system which is capable of being made sufficiently reliable to fulfil the safety requirements applicable to personnel carrying lifts.

The present invention also aims to provide a lift control system, which is economical in terms of required components, and which is efficient in its use of energy, and in which regulation of fluid flow to the actuating means is load and temperature compensated and substantially independent of pump flow provided the pump flow reaches a predetermined minimum.

In outline, the present invention comprises a hydraulic system including a pilot controlled, pressure operated, spool valve which acts substantially as a by-pass valve when regulating supply of fluid to actuating means, and as an in-line valve when regulating the return flow of fluid from the actuating means to tank, and which provides both these regulating functions by virtue of a single main valve spool. Suitable actuating means include, inter alia, cylinder actuators and reversible hydraulic motors.

The afore-mentioned load and temperature compensation is provided by including in the service line from the main valve to the actuating means a flow sensor which provides negative feedback to the main valve control in both the by-pass and the in-line mode of operation. The feedback may be provided hydraulically or electrically in the manner disclosed, for example, in the published European Patent Application 0023416 in the name of Sperry Ltd.

To improve reliability of operation, for instance, in the above mentioned case of lifts, where it is essential that a lift once it has reached the desired level remains at that level for what may be a considerable length of time, the system may additionally incorporate a releasable non-return valve in the service line from the main valve to the actuating means. Releasable non-return valves are commercially available, and the valve is to be inserted into the service line such that it opens under the pressure of the fluid flowing from the valve to the actuating means, closes under the back pressure produced by the restoring force when fluid flow to the actuating means is halted, and is opened by a suitable actuating mechanism which, for instance, may itself be hydraulic and be controlled by a further hydraulic valve.

Economy in the choice of components may be achieved by modifying a commercially available hydraulic spool valve such as, for instance, a valve as disclosed in the published G.B. Patent Application 2 050 646 (Sperry Rand Corporation).

Regulating the supply of fluid to the load in a by-pass mode, rather than by in-line control, has the added advantage of permitting the use of a fixed displacement pump at near maximum efficiency. A fixed displacement pump is generally less complicated and therefore cheaper than a variable displacement pump of comparable performance.

Moreover, since regulating the fluid flow to the actuating means in a by-pass mode, with all the fluid being immediately returned to tank when no fluid supply to the actuating means is required, means that the outlet pressure of the pump does not exceed the pressure required at the actuating means, except by a small amount because of losses within the hydraulic system; and the pump outlet pressure is practically equal to tank pressure when no fluid supply to the actuating means is required. This, obviously, leads to greater energy efficiency and consequential savings in the operation of the whole system.

Where the system operates a hydraulic lift, the lift will normally be propelled upwards by the pressure of the hydraulic fluid and return downwards under its own weight. Other arrangements, in which, for instance, the hydraulic actuator acts on a counter-weight to the lift, can readily be envisaged and are included in the scope of the present invention.

Figure 2:
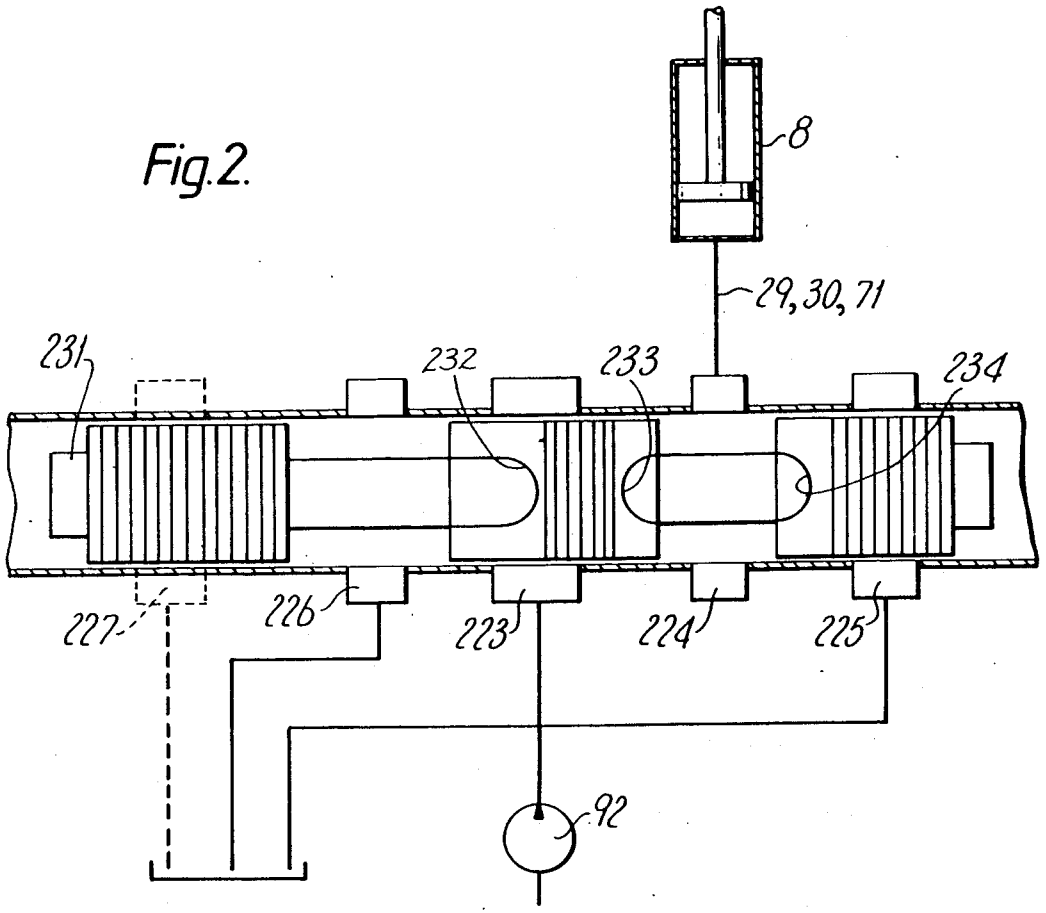

The present invention will now be described further by way of example, and with reference to the accompanying drawings of which:

FIG. 1 shows in schematic form a hydraulic lift control system incorporating the present invention; and FIG. 2 shows an alternative main valve arrangement for the system of FIG. 1.

Referring to FIG. 1, the main components of the hydraulic system illustrated in this Figure are a main valve 2, a pilot valve 5 with attached force motor, a releasable, hydraulically operated non-return valve 7, a hydraulic actuator 8 for propelling a lift (not shown), and a further spool valve 9.

The main valve 2 comprises a valve body 21 in which a landed main spool 31 is housed in a main valve bore 22. Various ports which cooperate with the lands of the spool 31, open into the main valve bore 22. These are a supply line port 23, a service line port 24, an exhaust port 25, a tank return port 26, and a by-pass port 27. Of these, the ports 23, 25 and 26 are connected directly with their respective external ports 23', 25', 26' in the connector face plate 40 at the bottom of the main valve 2. The connection between the port 24 and its external port 24' is via fluid ducts 29 and 30, leading to and from a variable aperture flow sensor 20 which provides negative flow feedback. Supply line port 23 and by-pass port 27 are permanently connected by an internal fluid duct 28 in the valve body 21. Unless and until fluid pressure needs to be supplied to the hydraulic actuator 8, the fluid supplied to the supply port 23 by-passes the load and is immediately returned to tank via fluid duct 28 and the tank port 26. In order to minimise the effects of back pressure in the tank return line onto to the exhaust port 25, and vice versa, these two ports, 25 and 26, are provided with separate fluid lines to tank.

Two return springs, 42 and 44, located in the left and right end chambers 41 and 43, respectively, of the main valve 2, act to centre the valve spool 31 within the valve bore 22. The two end chambers 41 and 43 are connected via lines 64 and 65 through a connector plate 6 to the pilot valve 5, whose function is to control the pressures within the two end chambers 41 and 43.

The supply control land 32 cooperates with the supply line port 23 and the service line port 24, to enable the service line 71, and therefore the actuator 8, to be connected to and disconnected from the supply line. It should be noted that the supply control land 32 does not obstruct free flow of fluid from the supply line port to the fluid duct 28. The exhaust control land 33 cooperates with the service line port 24 and the exhaust port 25, to control fluid flow from the service line 71 to tank. The rate of fluid flow to the actuator 8 is mainly regulated by the by-pass control land 34 cooperating with the tank return port 26 and the by-pass port 27. There is thus provided a variable aperture in a by-pass line to the actuator 8, from the inlet port 23 through the fluid duct 28 to tank. The lands 32 and 33 are shaped so as to provide, in the centre position of the spool 31 as shown in the drawing, a considerable overlap with the associated ports 23 and 25, sufficient to reduce leakage through the valve 2 to an acceptable minimum for the application concerned.

Fluid passages within the connector plate 6 provide the connection between the main valve 2 and the pilot valve 5. The pilot valve 5 is again a spool valve controlled by a force motor 55 which operates through shafts 59 on the spool 52 of the pilot valve. The pilot spool 52 is housed in a pilot valve bore 51 and has three lands. The center land 56 controls the amount of fluid directed from the pilot valve supply line 63 via fluid ducts 64 and 65 to the end chamber 41 and 43 respectively of the main valve 2. Those portions of the two end lands 57 and 58, which are nearest the centre land 56, cooperate in this function by controlling the proportion of fluid supplied by the pilot supply line 63, which is returned to tank via fluid line 66.

Although the position of the pilot valve is initially determined by the force motor 55, the pilot valve spool 52 is also acted on by a pressure differential between end chambers 53 and 54, the origin of which is at the flow sensor 20. This pressure differential is developed by fluid flowing through the flow sensor 20 and is transmitted to the end chamber 53 via fluid line 62 branching off fluid duct 29, and to end chamber 54 via fluid line 61 branching off the fluid duct 30. The pressure differential between end chambers 53 and 54 is arranged to provide a negative feedback to the pilot valve.

The main valve 2 is supplied with fluid under pressure by pump 92 and through a filter 95. A relief valve 97 acts as safety valve to prevent the pressure supplied to the main valve 2 from rising above a predetermined maximum. The pump 92 is driven by a motor 91 to which is coupled a further pump 93 which provides the fluid supply both to the pilot valve 5 and to the releasable non-return valve 7. Fluid supply to both these valves is controlled by the spool valve 9, the function of which will be described below. The fluid supply to the non-return valve 7 and the pilot valve 5 is similarly provided with a filter, 96, and a relief valve 94. If a single pump is to fulfil the functions of both pumps 92 and 93, it is, of course necessary to ensure, e.g. by placing a baffle into the supply line downstream of the branching point for the pilot and non-return valve supply, that sufficient pressure for the operation of the pilot valve 5 and the non-return valve 7 is available even when the pump is off-loaded. Such an arrangement would necessarily involve some penalty in the energy efficiency of the pump.

The hydraulic system just described operates as follows. When the spool of the main valve is in the center position as shown in FIG. 1, the connection between the supply line port 23 and the service line port 24 is closed by the supply control land 32, while the connection between the supply line port 23 and tank is, on account of the position of the by-pass control land 34, open to tank. The exhaust control land 33 blocks off the exhaust port 25 so that fluid is unable to flow either to or from the actuator 8, flow from the actuator 8 being additionally blocked by the releasable non-return valve 7. If it is desired to raise the piston arrangement 82 of the actuator 8 from the lowered position shown in the drawing, the main valve spool 31 needs to be moved towards the left, which is achieved by applying an appropriate demand signal to the force motor 55.

More specifically, the demand signal in this case has to be such as to cause the force motor 55 to shift the pilot spool 52 towards the left. As a result of this left shift, fluid from the pilot supply line 63 is admitted, via fluid line 65, to the right hand chamber 43. At the same time the right hand edge of the left hand land 57 at least partially clears the port leading to the tank line 66, and the left hand chamber 41 of the main valve is thus in communication with tank pressure. Since the supply line pressure is, of course, higher than the tank pressure, the pressure in the right hand chamber 43 of the main valve 2 exceeds the pressure in the left hand chamber 41, the main valve spool 31 moves to the left, and hydraulic fluid present in the left hand chamber 41, which is displaced by this movement, is returned through line 64 and the pilot valve 6 to tank. As the main valve spool 31 moves to the left, the connection between the supply line port 23 and the service line port 24 progressively opens. At the same time, and more importantly, the by-pass port 27 is progressively closed. Hence, less and less fluid is allowed to return to tank and the fluid pressure upstream of the by-pass port 27 begins to rise. Consequently, fluid begins to flow from supply line port 23 to service line port 24 and to the actuator 8.

The fluid flow from the service line port 24, via the fluid lines 29 and 30, to the hydraulic actuator 8 causes a pressure differential to be developed accross the flow sensor 20, which increases with increasing flow. This pressure differential is applied via fluid line 61 from fluid duct 30, and fluid line 62 from fluid duct 29, to the respective end chambers 53 and 54 of the pilot valve. As the pressure in line 29 is higher than that in line 30, it will be seen that the pressure differential counter-acts the force of the force motor 55 and, as flow increases, progressively pushes the pilot spool 52 back towards the centre position shown in the drawing. During this return to the center position, fluid flow to the right hand chamber 43, and fluid flow from the left hand chamber 41 to tank, are progressively reduced.

Once the pilot spool 52 has reached the center position, and once the main valve spool 31 has moved far enough to the left to equalise the forces produced by the respective pressures and the return spring action in the two end chambers 41 and 43, the main valve spool 31 is locked in position as long as the desired flow rate is maintained. Any change in the flow rate to the actuator produces a change in the pressure differential across the pilot valve, and the pilot spool 52 moves into a new position to cause the main spool 31 to restore the desired flow. Similarly, a change in the desired flow rate has the effect of changing the force with which the force motor 55 acts on the pilot spool 52, and again, the pilot spool 52 is moved under the combined action of the pressure differential and the force provided by the force motor 55 to adjust the flow through the main valve 2 to the desired value.

The further spool valve 9 is shown schematically only, with the three adjacent squares corresponding to the three flow patterns which can be set up through the valve, in its left hand, centre, and right hand positions. Assuming that the lift drive is such that raising the actuator raises the lift, when the lift is to ascend, the spool valve 9 is energised to operate according to the flow pattern shown in the left square, that is to say, fluid from pump 93 is admitted to the pilot supply line 63, and the hydraulic actuator of the releasable non-return valve 7 is connected to tank.

When the lift has been raised to the desired level, the demand signal to the force motor 55 becomes such as to cause a return of the main valve spool 31 to its centre position. Returning the main spool 31 to the centre position will shut off flow to the actuator 8 and once again open the by-pass line fully to the tank return port 26. Fluid from the pump 92 therefore, freely passes through the valve with only a minimal pressure drop, and as a result the pump 92 is substantially off-loaded. At the same time fluid is prevented from returning from the actuator 8 to tank, firstly by the non-return valve 7, and secondly by the position of the land 33, which prevents fluid flow from the service line port 24 to the exhaust port 25. By now moving the spool valve 9 to its centre position, in which the pilot supply line 63 and the actuator of the release valve 7 are both connected to tank, the non-return valve 7 remains closed, and the pilot valve 5 is rendered inoperable so that any spurious demand signals to the force motor 55 will not cause any further movement of the lift.

While the lift is stationary its weight will, of course, exert a force on the piston arrangement 82, but due to the non-return valve 7 being closed and the main valve 2 being also shut, the lift will remain in its current position.

If it is desired to lower the lift, i.e., to allow fluid from the actuator 8 to return to tank, the spool valve 9 is moved into the position indicated by the right hand side of the three flow patterns. In this position the actuator (not shown) of the release valve 7 opens the release valve 7, and at the same time fluid supply to the pilot valve 5 via fluid supply line 63 is re-established. The demand signal to the force motor is now selected to move the pilot spool towards the right. Hence, the main valve spool 31 is also shifted to the right. The by-pass path from the supply line port 23, through the internal passage 28, and the by-pass port 27 to the tank port 26, is still unobstructed and a connection between service line port 24 and exhaust port 25 is established on account of the right shift of the land 33. Fluid is thus allowed to drain, in a controlled manner, from the actuator 8 via the service line 71, the non-return valve 7, the fluid lines 30, 29 and the service line port 24 to the exhaust port 25, and hence to tank. This fluid flow will once again result in a pressure differential being developed across the flow sensor 20, but this pressure differential will be in the opposite direction to that established during the ascent of the lift. However, since the pilot spool 52 has also moved in the opposite direction, it will be seen that this feedback pressure differential will once again tend to counter-act the force on the pilot spool 62 from the force motor 55 and to restore the pilot spool 52 to its centre position.

Once the lift has descended to the desired level, flow through the main valve is again reduced to zero, the spool valve 9 is returned to its centre position, thereby causing the pilot valve to become inoperable and the non-return valve 7 to close again under the influence of the fluid pressure in the service line 71. No further movement of the lift can take place until a fresh command for lowering or raising is received.

By suitably timing the operation of the spool valve 9, and therefore the non-return valve 7, it is envisaged that smooth and uniform acceleration and deceleration of the lift can be ensured. The spool valve 9 may, if desired, be replaced by two independently operable valves, one to control fluid supply to the pilot valve 5, the other to control actuation of the non-return valve 7. In certain circumstances the latter arrangement may be more convenient, for instance to achieve a suitable timing sequence for the main, pilot, and non-return valves which cannot be obtained with a single spool valve 9.

FIG. 2 shows schematically an alternative lay-out of the ports and lands of the main valve. Since the configuration and interaction of the remaining components such as, for instance, the non-return valve 7, the spool valve 9, the pilot valve etc., is practically identical to that of FIG. 1, these components, have been omitted from FIG. 2 for the sake of convenience.

In the main valve of FIG. 2, fluid is supplied to the valve via supply line port 223 and, in the centre position which is shown in FIG. 2, passes to tank return port 226. In this position, the service line port 224 is isolated from both the supply line port 223 and the exhaust port 225. If fluid is to be supplied to the actuator 8, the spool 231 is made to move towards the left in the manner described above in relation to FIG. 1. As the spool is shifted towards the left, the by-pass flow back to tank is progressively reduced, while at the same time a progressively less restrictive connection is made between the supply line port 223 and the service line port 224. Exhaust port 225 is still obstructed by the exhaust control land 234. The left hand land 232 of the spool permanently obstructs the port 227 which, in this configuration, has no function to perform, and is retained only to illustrate how the valve body 21 of FIG. 1 may be usefully retained.

When the lift has been raised to the desired level, the main valve spool 231 is returned to its centre position, and fluid is prevented from flowing either to or from the actuator 8. Timing of the further spool valve (spool valve 9 of FIG. 1) and the non-return valve (7) proceeds in the manner described earlier.

To lower the lift, the main spool 231 is shifted towards the right, which leads to progressive opening of the exhaust port 225. Hence, fluid from the actuator 8 is returned in a controlled manner via the exhaust port 225 to tank. The by-pass flow from the pump to the tank return port 226 is again not in any way impeded during the descent of the lift.

With the foregoing example, a hydraulic system including the present invention has been described in relation to a lift system in which the lift is raised through raising the hydraulic actuator 8 by supplying fluid under pressure to the underside of the actuator piston. The system of the present invention will equally operate in other hydraulic lift systems in which, for instance, the actuator pulls rather than pushes the lift or, in other words, in which fluid is supplied to the topside rather than the underside of the piston.

Equally, the invention may of course be used in systems other than lift systems, provided the actuator is subject to a restoring force which counter-acts movement of the actuator when supplied with fluid under pressure, and which, hence, tends to restore the actuator and the load to its original position.

I claim:

1. A hydraulic closed loop lift control system comprising pump means operable to effect a supply of fluid, a control valve arrangement, actuating means for raising, lowering and holding lift means against gravity, service line means connecting said actuating means to the control valve arrangement, the control valve arrangement comprising a pressure operated main valve, a proportional pilot stage to operate the main valve and being responsive to a negative flow-feedback signal indicative of fluid flow to and from the actuating means in both the power or up operating mode and the gravity or down operating mode, flow sensing means to generate and supply the flow-feedback signal to the pilot stage, said main valve being a spool valve including a valve spool provided with first land means co-operating with first port means to allow free flow of pressure fluid from the fluid supply means through the service line means to the actuating means, and second land means cooperating with first tank port means to control fluid flow to the actuating means in a by-pass mode when the spool is disposed to one side of a neutral position to raise the lift means; with third land means co-operating with second tank port means to connect the service line means to said second tank port means to control return flow from the actuating means through the service line means to tank when the spool is displaced from the neutral position to another side to lower the lift means under gravity, whereby the pump means is off-loaded to tank in this mode of operation; and with the first land means blocking the first service port means from the fluid supply means when the valve is in the neutral position, and the third land means blocking the connection between the second tank port means and the first service port means, whereby the pump means is off-loaded in this mode of operation and whereby the actuating means is thus held stationary.

2. A hydraulic lift control system as claimed in claim 1 wherein the flow sensing means are located in the service line means.

3. A hydraulic lift control system as claimed in claim 1 further comprising releasable non-return valve means in the service line to the actuator which opens under pressure of fluid flowing from the main valve to the actuator and closes under back pressure of the load, and non-return valve release means to effect opening of the non-release valve means when the lift means is to be lowered.

* * * * *